US010669810B2

(12) United States Patent
Egbe et al.

(10) Patent No.: US 10,669,810 B2
(45) Date of Patent: Jun. 2, 2020

(54) CONTROLLING WATER INFLOW IN A WELLBORE

(71) Applicant: Saudi Arabian Oil Company, Dhahran (SA)

(72) Inventors: Peter Ido Egbe, Abqaiq (SA); Fawaz Musaad AlShuraim, Abqaiq (SA)

(73) Assignee: Saudi Arabian Oil Company, Dhahran (SA)

( * ) Notice: Subject to any disclaimer, the term of this patent is extended or adjusted under 35 U.S.C. 154(b) by 94 days.

(21) Appl. No.: 16/004,965

(22) Filed: Jun. 11, 2018

(65) Prior Publication Data

US 2019/0376365 A1 Dec. 12, 2019

(51) Int. Cl.

| | |
|---|---|
| ***E21B 34/06*** | (2006.01) |
| ***E21B 47/18*** | (2012.01) |
| ***E21B 49/08*** | (2006.01) |
| ***E21B 34/00*** | (2006.01) |

(52) U.S. Cl.

CPC ..... *E21B 34/06* (2013.01); *E21B 47/18* (2013.01); *E21B 49/08* (2013.01); *E21B 2034/007* (2013.01); *E21B 2049/085* (2013.01)

(58) Field of Classification Search

CPC ..... E21B 34/06; E21B 47/18; E21B 49/08; E21B 2049/085

See application file for complete search history.

(56) References Cited

U.S. PATENT DOCUMENTS

| | | | | |
|---|---|---|---|---|
| 5,905,036 | A * | 5/1999 | Pope | B09C 1/00 166/250.01 |
| 8,025,072 | B2 | 9/2011 | Atkinson et al. | |
| 8,330,617 | B2 | 12/2012 | Chen et al. | |
| 8,657,015 | B2 | 2/2014 | Patel | |
| 8,776,890 | B2 | 7/2014 | Basmajian et al. | |
| 8,789,581 | B2 | 7/2014 | Fripp et al. | |

(Continued)

FOREIGN PATENT DOCUMENTS

| | | |
|---|---|---|
| EP | 2414628 A1 | 2/2012 |
| EP | 2569507 A2 | 3/2013 |

(Continued)

OTHER PUBLICATIONS

International Search Report for PCT/IB2018/056525, 7 pages (dated Apr. 25, 2019).

(Continued)

*Primary Examiner* — Nicole Coy
(74) *Attorney, Agent, or Firm* — Choate, Hall & Stewart LLP; Peter A. Flynn; Charles E. Lyon

(57) ABSTRACT

An example system includes a casing for insertion into a wellbore that includes one or more inflow control devices (ICDs). The ICDs may be disposed along the casing string to control the inflow of water into the wellbore. The system may include one or more controllers, each of which may be associated with an ICD. The controllers may be configured to receive a radio frequency identification (RFID) and to determine whether the associated ICD is a target for the RFID. A target ICD may be an ICD associated with a water cut zone. If the ICD is the target for the RFID, the controller is configured to control the ICD to open or close, thereby controlling the inflow of water. If the ICD is not the target for the RFID, the controller is configured to repeat the RFID.

24 Claims, 9 Drawing Sheets

(56) References Cited

U.S. PATENT DOCUMENTS

| | | | | |
|---|---|---|---|---|
| 8,820,416 | B2 | 9/2014 | Holderman | |
| 8,839,850 | B2 | 9/2014 | Algeroy et al. | |
| 8,981,957 | B2 | 3/2015 | Gano et al. | |
| 9,091,133 | B2 | 7/2015 | Stewart et al. | |
| 9,121,250 | B2 | 9/2015 | Godfrey et al. | |
| 9,194,226 | B2 * | 11/2015 | Blair | E21B 47/1015 |
| 9,273,549 | B2 | 3/2016 | Walton et al. | |
| 9,303,485 | B2 | 4/2016 | Hecker et al. | |
| 9,804,291 | B2 | 10/2017 | Adil et al. | |
| 2002/0163441 | A1 | 11/2002 | Hill et al. | |
| 2009/0034368 | A1 * | 2/2009 | Johnson | E21B 47/14 367/83 |
| 2011/0155368 | A1 | 6/2011 | El-Khazindar | |
| 2011/0192596 | A1 | 8/2011 | Patel | |
| 2015/0354351 | A1 | 12/2015 | Morrow et al. | |
| 2016/0010454 | A1 * | 1/2016 | Sira | E21B 47/1015 73/152.29 |
| 2016/0237803 | A1 | 8/2016 | Patel | |
| 2016/0312579 | A1 * | 10/2016 | Green | E21B 34/10 |
| 2017/0030173 | A1 | 2/2017 | Macphail et al. | |
| 2017/0114615 | A1 | 4/2017 | Saldanha et al. | |
| 2017/0356287 | A1 | 12/2017 | Roddy | |
| 2018/0087369 | A1 * | 3/2018 | Sherman | E21B 29/00 |
| 2018/0155991 | A1 | 6/2018 | Arsalan et al. | |

FOREIGN PATENT DOCUMENTS

| | | | |
|---|---|---|---|
| EP | 2900906 | A1 | 8/2015 |
| WO | WO-2010/117659 | A1 | 10/2010 |
| WO | WO-2011/082066 | A1 | 7/2011 |
| WO | WO-2011/097063 | A2 | 8/2011 |
| WO | WO-2011/141687 | A2 | 11/2011 |
| WO | WO-2012/082447 | A1 | 6/2012 |
| WO | WO-2014/051564 | A1 | 4/2014 |
| WO | WO-2016/010540 | A1 | 1/2016 |
| WO | WO-2016/085465 | A1 | 6/2016 |
| WO | WO-2016/167811 | A1 | 10/2016 |
| WO | WO-2017/074364 | A1 | 5/2017 |

OTHER PUBLICATIONS

Written Opinion for PCT/IB2018/056525, 14 pages (dated Apr. 25, 2019).

Invitation to Pay Additional Fees PCT/SA/206 for PCT/IB2018/056525, 14 pages (mailed Feb. 14, 2019).

* cited by examiner

CONTROLLING WATER INFLOW IN A WELLBORE

TECHNICAL FIELD

This specification relates generally to systems for controlling water inflow in a wellbore, which may occur in water cut zones.

BACKGROUND

Inflow control devices (ICDs) include valves that control the flow of fluid produced from a formation into a wellbore. This fluid, which may be referred to as production fluid, may contain varying amounts of water and oil. Areas in which the amount of water in the fluid exceeds a predefined level may be referred to as water cut zones. Systems for analyzing the fluid entering an ICD may be used to determine the amount of water entering the ICD and to identify the water cut zone based on the amount of water. An ICD may be closed when a water cut zone is identified.

SUMMARY

An example system for controlling inflow of water in a wellbore includes a casing string for insertion into a wellbore and one or more inflow control devices (ICDs) disposed along the casing string. The ICDs are configured to control the inflow of water into the wellbore. The system includes one or more controllers. The controllers are configured to receive a radio frequency identification (RFID) and to determine whether an ICD is a target for an RFID. If the ICD is a target for an RFID, the controller is configured to control the ICD to control the inflow of water by opening or closing the ICD. If the ICD is not the target for an RFID, the controller is configured to repeat the RFID. The example system may include one or more of the following features, either alone or in combination.

The system may include a device to identify a water cut zone associated with an ICD based on one or more properties of fluid entering the ICD. The fluid may include water and oil. The device may be configured to transmit information based on the one or more fluid properties. The fluid properties may include the density of the fluid, the salinity of the fluid, or both the density and salinity of the fluid. The device may transmit the information by emitting a pressure pulse that is unique to the device. The system may also include a computing system configured to identify the pressure pulse from the device and correlate the pressure pulse to a location of the device downhole to identify a location of the water cut zone.

The system may include one or more chemical tracers that are associated with an ICD to identify a water cut zone. The water cut zone may be identified based on one or more fluid properties of fluid entering the ICD from the water cut zone. The fluid may be water and oil and the chemical tracers may be configured to react with the water, oil or both water and oil. The system may include two chemical tracers—one for reacting with water and one for reacting with oil entering the ICD.

A computing system may be configured to identify the chemical tracers and determine, based on reactions with the one or more chemical tracers, an amount of water, an amount of oil, or the amount of water and the amount of oil in a fluid entering an ICD. A water cut zone can be identified based the amount of water, the amount of oil or the amount of water and the amount of oil. The computing system may be located at the surface of the wellbore. The wellbore allows the chemical tracer to pass to the surface for analysis. The computing system may be configured to identify the one or more chemical tracers and correlate them to a location of an ICD downhole in order to identify the location of a water cut zone.

The controllers may be configured to control the inflow of water by closing the ICD when the ICD is the target for the RFID. The controllers may be configured to receive an RFID from another, different controller located uphole in a wellbore. The controllers may be configured to receive an RFID from a device located downhole in the wellbore.

An example method includes analyzing fluid from one or more inflow control devices (ICDs) disposed along a casing string in a wellbore in order to determine a property of the fluid. The example method includes identifying a water cut zone in the wellbore based on the property of the fluid and identifying a target ICD associated with the water cut zone. The example method includes transmitting an RFID downhole in the wellbore. The RFID may include an instruction that is addressed to a target controller among multiple controllers associated with respective ICDs. At least some of the controllers may be configured to repeat the RFID within the wellbore so that RFID reaches the target controller. The target controller may control an ICD associated with the target controller based on the instruction. The example method may include one or more of the following features, either alone or in combination.

The fluid may be analyzed to determine one or more properties indicative of a water cut zone. Information based on the one or more properties may be transmitted to a computing system. The information may represent a density of the fluid, a salinity of the fluid, or both a density of the fluid and a salinity of the fluid. The information may be transmitted by emitting a pressure pulse from the associated ICD. The pressure pulse from the controller may be unique to the ICD associated with that controller. The information may be received by a computing system. The computing system may identify a pressure pulse based on the information and correlate the pressure pulse to a location of the water cut zone.

The fluid entering an ICD may be analyzed by identifying one or more chemical tracers in the fluid. The one or more chemical tracers may be configured to react with water or oil. The amount of the one or more chemical tracers in the fluid may be measured. The amount corresponds to the amount of at least one of water or oil in the fluid. The one or more chemical tracers may include two chemical tracers. One of the chemical tracers may react with the water and one of the chemical tracers may react with the oil.

The example method may include directing fluid to a location containing a fluid analyzer. The fluid analyzer may provide information to a computing system. The computing system may identify the amount of oil and water in the fluid based on the information. The computing system may be configured to identify a chemical tracer and correlate the chemical tracer to a location of an ICD at a location of the water cut zone.

The target controller may receive an RFID from a different controller uphole of the target controller or from a device downhole of the target controller.

Any two or more of the features described in this specification, including in this summary section, can be combined to form implementations not specifically described in this specification.

The systems, techniques, and processes described in this specification, or portions of the systems, techniques, and processes, can be controlled by a computer program product that includes instructions that are stored on one or more non-transitory machine-readable storage media, and that are executable on one or more processing devices to control (for example, to coordinate) the operations described in this specification. The systems, techniques, and processes described in this specification, or portions of the systems, techniques, and processes, can be implemented as an apparatus, method, or system that can include one or more processing devices and memory to store executable instructions to implement various operations.

The details of one or more implementations are set forth in the accompanying drawings and the description below. Other features and advantages will be apparent from the description and drawings, and from the claims.

DESCRIPTION OF THE DRAWINGS

Like reference numerals in different figures indicate like elements.

DETAILED DESCRIPTION

An example system for controlling production fluid flow into a wellbore may include one or more inflow control devices (ICDs) installed along a completion string in the wellbore. An ICD includes a channel or valve that may selectively open or close to allow or to block production fluid from entering the wellbore. Production fluid may contain varying amounts of water and oil. ICDs may be opened or closed based on the relative amounts of water and oil present in the production fluid. Areas in which there is excessive water flow into a wellbore may be referred to as water cut zones. The amount of water that constitutes excessive water flow may be different for different types, sizes, or other features of a wellbore.

Figure 1:
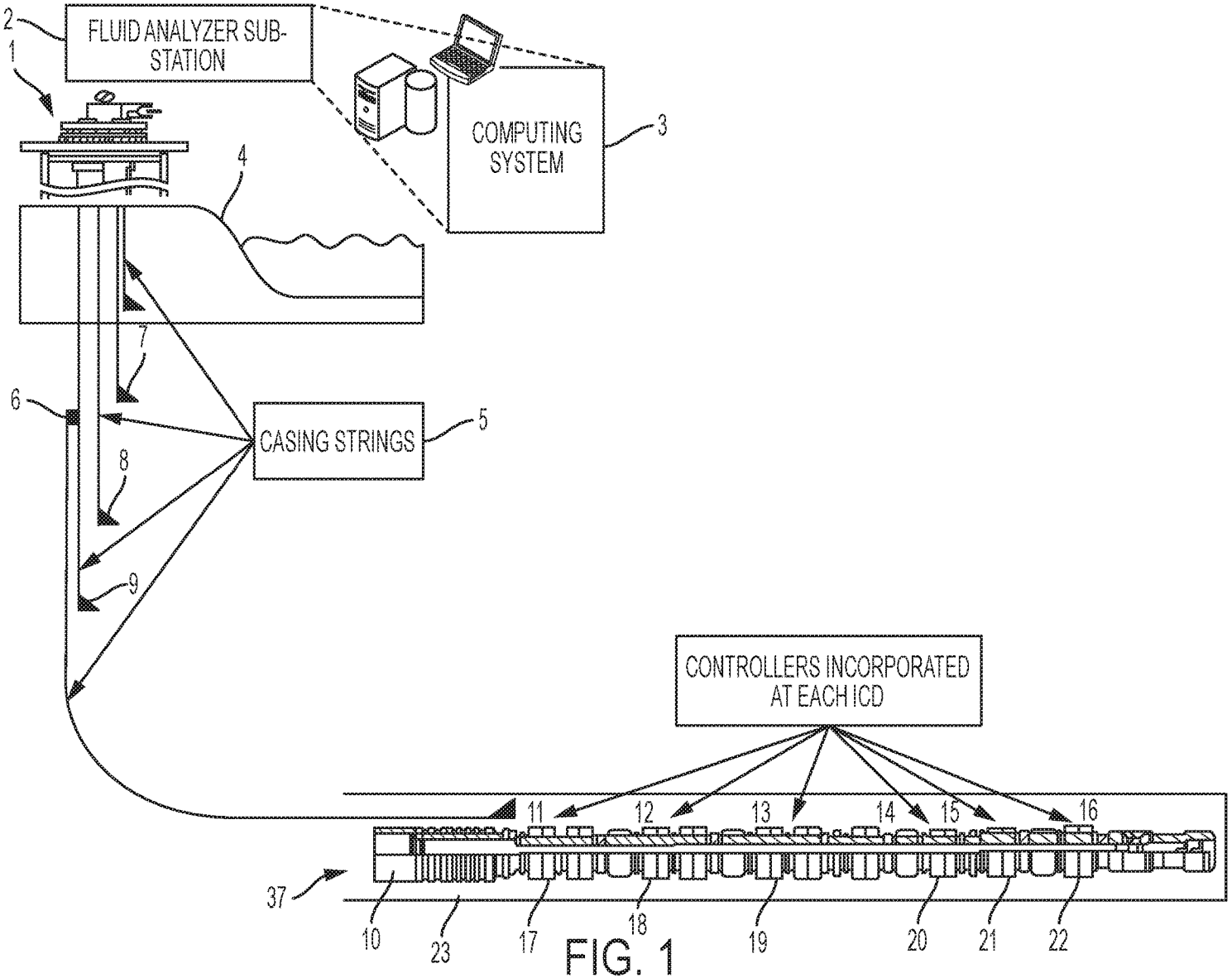
FIG. 1 is a cut-away, side view of an example well having a completion string that includes inflow control devices (ICDs).

FIG. 1 shows an example system for controlling the amount of water—or water cut—in a wellbore of an oil well. An oil well is used as an example in this specification; however, the systems and methods are not limited to use with oil wells. To form oil well 1, a wellbore 37 is drilled through a formation. Casings 5 are installed in and line the wellbore. Casings 5 may form a casing string. In this example, casings 5 include liner hangers 6, and casing strings 7, 8, and 9. The liner and casings are used to construct and line the wellbore. Completion string 10 is part of the casing string and is installed at the completion zone or production zone during formation of the well. A completion string includes one or more tubings, such as a tubing string, that complete the well. The example system also includes fluid analyzer sub-station 2 located at ground level 4. The fluid analyzer sub-station includes a computing system 3. Computing system 3 may be any type of computing system, such as those described in this specification.

One or more ICDs may be deployed on the completion string, as shown in FIG. 1. Although the ICDs are on the completion string in this example, the ICDs may be at any point in the tubing string between the ground and the bottom of the well. In FIG. 1, the ICDs include ICDs 17, 18, 19, 20, 21, and 22. The ICDs may be positioned in various locations along completion string 10. An example ICD may include a sleeve that slides open to open a path for fluids to pass into the wellbore or that slides closed to close a path for fluids to enter the wellbore. Locations of the ICDs may be stored in the memory of computing system 3. The locations may be determined based on a geological analysis of the formation and on prediction of the location of production zones in the formation. The production zones may include zones predicted to have a certain oil to water ratio or a certain amount of oil in the production fluid.

Systems may be used for measuring the properties of production fluid entering each ICD. The systems may be at any location, such as the surface (for example, at computer system 3) or downhole (for example, at each ICD). The production fluid may be characterized by the amount of water, the amount of oil, the amount of gas, the ratio of oil to water, the ratio of oil to gas, or the ratio of water to gas in the fluid. One or more processing devices, such as in computing system 3, may be configured—for example, programmed—to receive data based on measured properties of the production fluid and to determine the amount of water and oil entering the wellbore based on the data received. For example, the computing system may determine the proportion or amount of water in the production fluid, the proportion or amount of oil in the production fluid, or the ratio of oil to water in the production fluid. If a water cut zone is identified, for example based on the relative amounts of oil and water entering the wellbore, the computing system may generate an output signal encoding instructions to initiate closure of one or more ICDs in the water cut zone.

Different techniques may be used to obtain measurements of production fluid properties. For example, chemical tracers may be used to react with, and to indicate, the type of fluid entering the well. In some implementations, fluid analyzer devices may be installed at each ICD to measure a density or a salinity of the production fluid. Data based on these measurements may be received and processed by the computing system to determine if a water cut zone is present.

This system may also include one or more controllers. In FIG. 1, controllers 11, 12, 13, 14, 15, and 16 are incorporated into each respective ICD 17, 18, 19, 20, 21, and 22 on completion string 10. Each controller may be associated with a corresponding ICD. For example, a controller may be incorporated into or embedded into each ICD. The controllers may be devices, such as microprocessors, configured to receive and to transmit radio frequency identification (RFID) signals. An RFID signal may include an RFID signature (or simply "RFID") and instructions, which may be encoded, for operating an ICD having the RFID signature. In this regard, each controller may be configured to determine whether an ICD is a target for an RFID in an RFID signal. Furthermore, each controller may be configured to store and to process information encoded in the RFID signals. The controllers may be configured to control opening and closing of the ICDs based on the instructions contained in RFID signals.

The controllers and the computing system may be configured to communicate wirelessly with each other and with other entities. In some implementations, the controllers and the computing system may be connected using wires, such as Ethernet, for communication. In some implementations, communications between the controllers and computing system may be a mix of wired and wireless communications Fluid analyzer sub-station 2 may include equipment to measure chemical tracer in a production fluid sample. Systems for measuring chemical tracer may depend on the type of chemical tracer used. Example systems for measuring chemical tracers include mass spectrometry or, if using a radioactive chemical tracer, a scintillation detector. Fluid analyzer sub-station 2 may also include one or more pressure sensors to receive and to decode signals received from downhole fluid analyzer devices.

Figure 2:
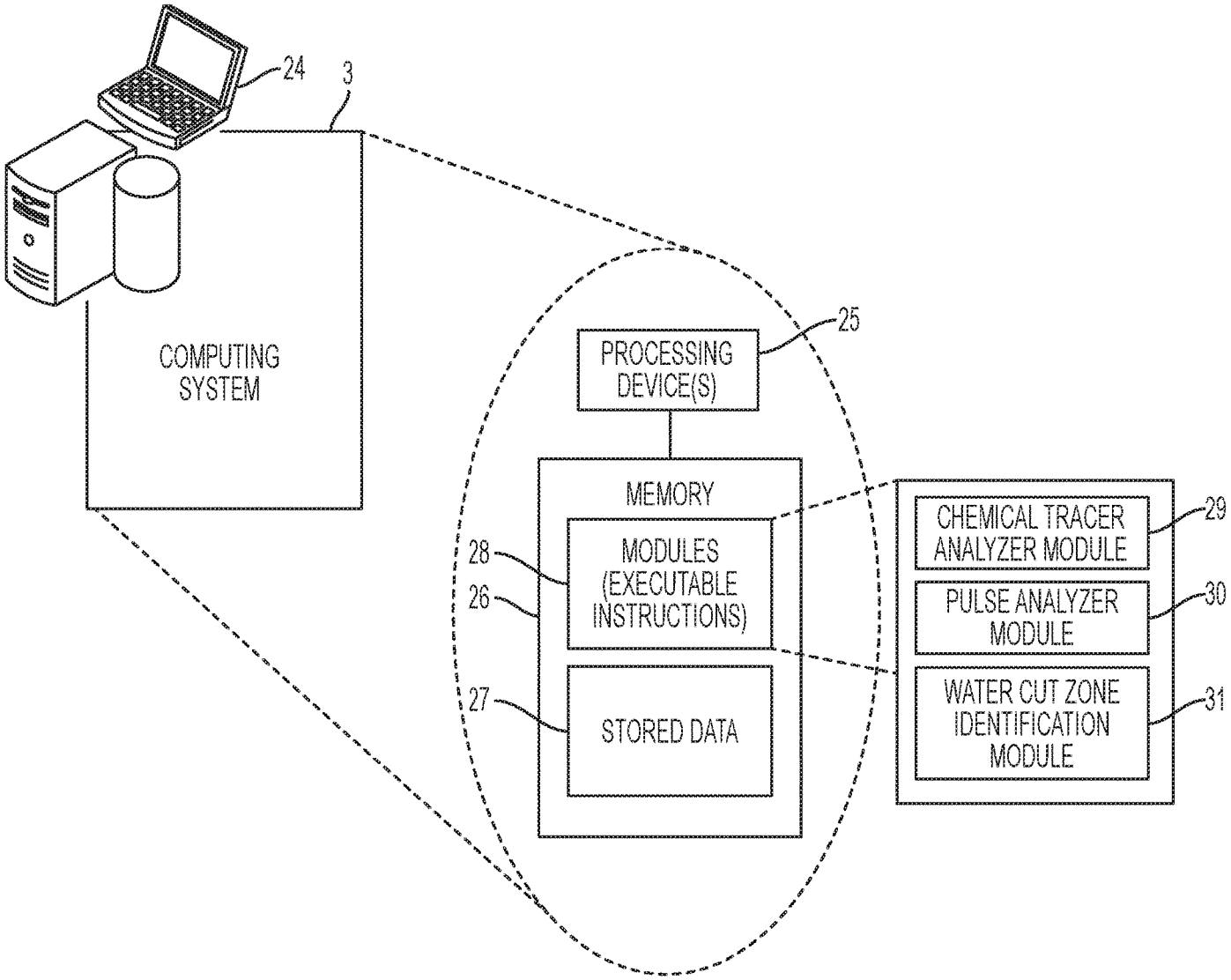
FIG. 2 is a block diagram of an example of a computing system that is located at a surface, or ground level, and that is part of a production monitoring system.

Referring to FIG. 2, a fluid analyzer sub-station may include a computing system 3. Computing system 3 include a display device 24 having a display screen, one or more processing devices 25, and memory 26 storing data 27.

Data 27 may include measurements of properties of production fluid entering the ICDs downhole. Data 27 may also include one or more of the following: locations of the ICDs along the completion string, types of chemical tracers incorporated into each ICD, information identifying individual fluid analyzer devices and their location downhole, RFID signatures of the ICDs downhole, and information identifying properties of production fluid entering a wellbore tracked over time.

Memory 26 may also store modules 28 to process data 27—for example, in real-time—to identify and to control the isolation of water cut zones in a well. Modules 28, may be computer programs or routines, and may include executable instructions that, when executed by a processing device, perform a function or functions. Water cut zones may be identified by execution of one or more modules.

Modules 28 include pulse analyzer module 30. Pulse analyzer module 30 is configured to generate data based on pressure pulses received from downhole, as described subsequently. The data may represent amounts of water in the production fluid or relate to chemical tracers in the production fluid. Modules 28 include chemical tracer analyzer module 29. Chemical tracer analyzer module 29 is configured to analyze the data generated by the pulse analyzer module in order to determine the amount of water in a production fluid sample based on the chemical tracers.

Modules 28 also include water cut zone identification module 31. Water cut zone identification module 31 is configured to identify a presence and a location of a water cut zone by analyzing the output of chemical tracer analyzer module 29 or pulse analyzer module 30. For example, water cut zone identification module 31 may compare the amount of water determined by the chemical tracer analyzer module 29 or based on the data output by pulse analyzer module 30 to a predetermined threshold and determine if the amount of water exceeds the threshold.

Modules 28 may be configured to generate data for a graphical output or alert on a display screen of display device 24. The data may represent, for example, the amount of water in the production fluid or the location of water cut zones. Modules 28 may also be configured to send instructions downhole to the ICDs. These instructions may be control instructions to open or to close one or more ICDs downhole. The instructions may include a control sequence specifying an order in which the ICDs downhole are to be opened or an order in which the ICDs downhole are to be closed.

Production fluid may be sampled at the surface periodically by fluid analyzer sub-station 2. In an example, fluid analyzer sub-station 2 may be configured to analyze production fluid in real-time. Real-time analysis may be useful in determining when the amount of water in the well is increasing. Real-time may include actions that occur on a continuous basis or that track each other in time, taking into account delays associated with processing, data transmission, hardware, and the like. In some implementations, fluid may be sampled as prompted by a worker at the site.

As discussed, the constituents of a production fluid may be identified using chemical tracers. Chemical tracers may react with water, oil, or both water and oil. Example chemical tracers may include a range of different, distinguishable polymers. An example chemical tracer may be a radioactive chemical tracer. Radioactive chemical tracers may have a limited usable lifetime. The lifetime of a chemical tracer in the wellbore may be the same as, or greater than, the amount of time that the well is active. Examples of chemical tracers may include alcohols and soluble ions such as nitrate (NO—), bromide (Br—), iodide (I—), and hydrogen borate (HOB—) or isotopes of water including deuterium and tritium. Other examples of chemical tracers may include fluorinated benzoic acid including mono-, di- and tri-fluorinated benzoic acids such as 2-fluorobenzoic acid, 4-fluorobenzoic acid, 2,6-fluorobenzoic acid, and trifluoromethylbenzoic acids. Oil-based chemical tracers may include iododecane, hexadecane, thiocyanate anion, and perfluorocarbon (gas). Other forms of chemical tracers may include short stranded deoxyribonucleic acid (DNA) fragments or magnetic nanoparticles. The chemicals may be carried in environmentally stable solvents.

Figure 4:
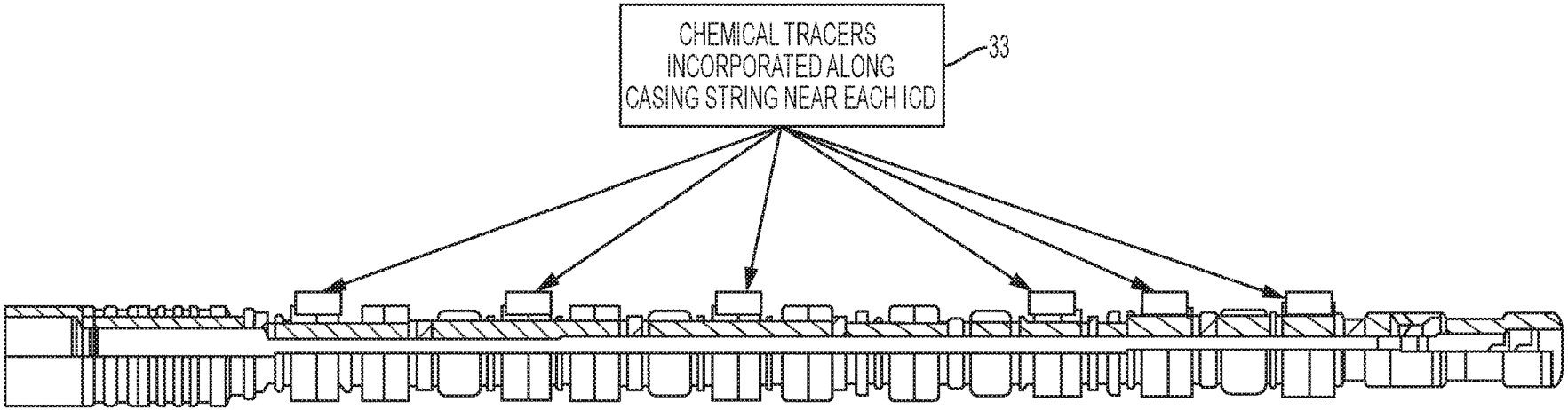
FIG. 4 is a cut-away, side view of an example completion string having ICDs, each containing chemical tracer to react with fluid entering the ICD.

In some implementations, one or more chemical tracers may be incorporated into an ICD. For example, one or more chemical tracers 33 may be incorporated into each ICD along the completion string of FIG. 4. Chemical tracers 33 may be at or near the ICD or incorporated into a compartment within the ICD. There may be one or more types of chemical tracer located at each ICD or at different ICDs. In some implementations, the chemical tracers may be embedded in a degradable material, and that degradable material may be incorporated into the completion string.

Figure 6:
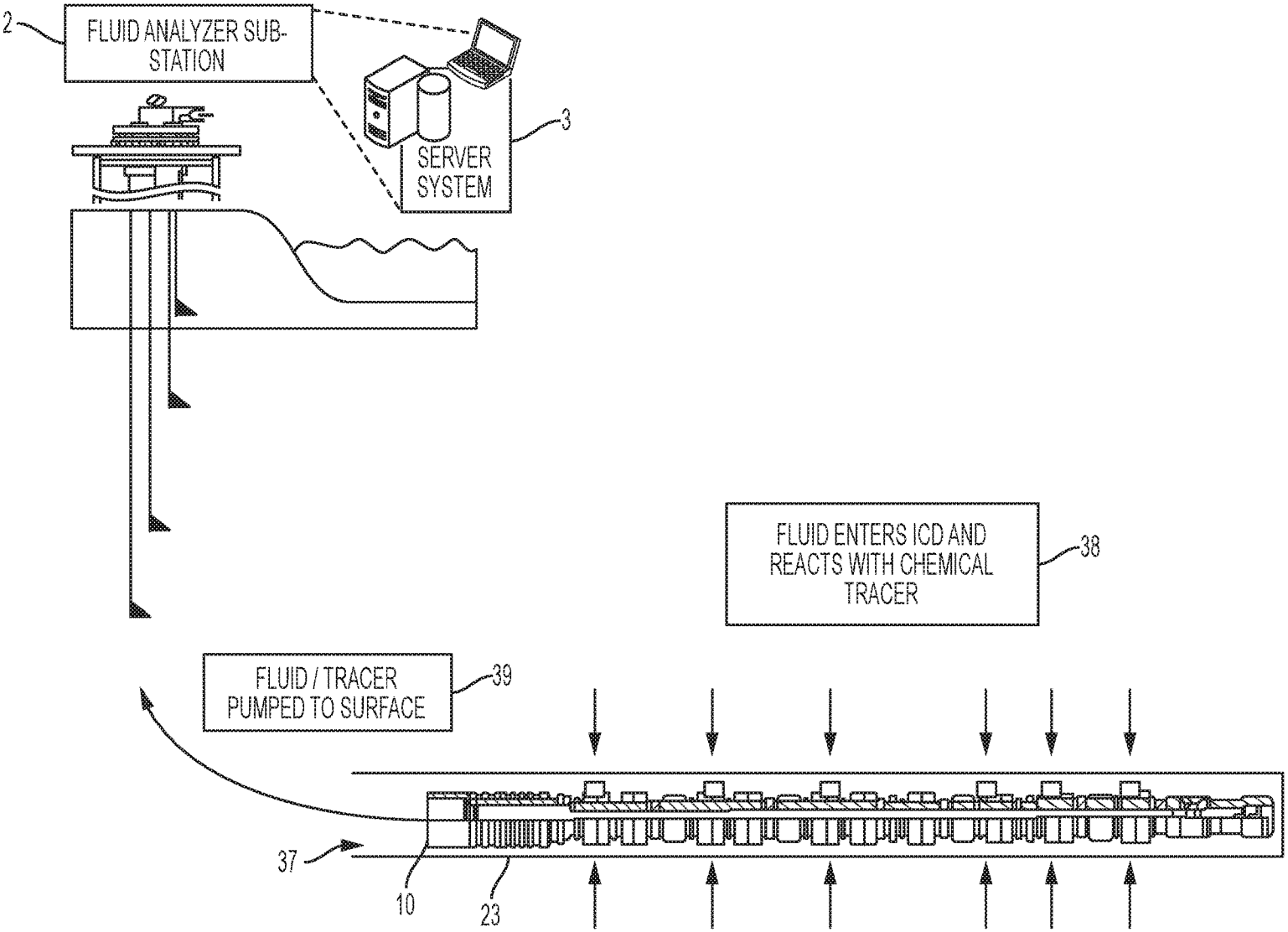
FIG. 6 is a cut-away, side view of an example system for identifying water cut zones that includes a chemical tracer incorporated into each ICD along a completion string.

As production fluid enters an ICD, the chemical tracers in or associated with that ICD may react with the production fluid. For example, a chemical tracer may react with water and another chemical tracer may react with oil. For example, a chemical tracer may react with both water and oil. But, that chemical tracer may react differently with water than with oil. As shown in the example of FIG. 6, production fluid from formation 23 enters wellbore 37 through the ICD and reacts (38) with the chemical tracer. The chemical tracer, which has reacted with the production fluid, flows with the production fluid that is pumped (39) to the surface. At the surface, the chemical tracer can be measured by fluid analyzer sub-station 2 and the resulting measurements analyzed by computing system 3 using the chemical tracer analyzer module.

Fluid analyzer sub-station 2 may be configured to measure and to quantify the chemical tracer in a fluid sample received from downhole. For example, computing system 3 may be configured—for example programmed—to identify one or more chemical tracers and to determine, based on reactions with the one or more chemical tracers, an amount of, or proportion of, water, oil, or both in the fluid sample. A water cut zone may be identified based on at least one of: the amount of the water, the amount of the oil, or both the amount of the water and the amount of the oil.

As noted, the same, or different, chemical tracer or chemical tracers may be used at each ICD. A unique mix of chemical tracers for an ICD may act as a signature for that ICD. The ICD from which a fluid sample is obtained may be identified based on the unique signature of the chemical tracer identified in fluid samples received. When a water cut zone is identified, an ICD in that zone may be identified based, for example, on that ICD's unique chemical tracer signature.

Figure 9:
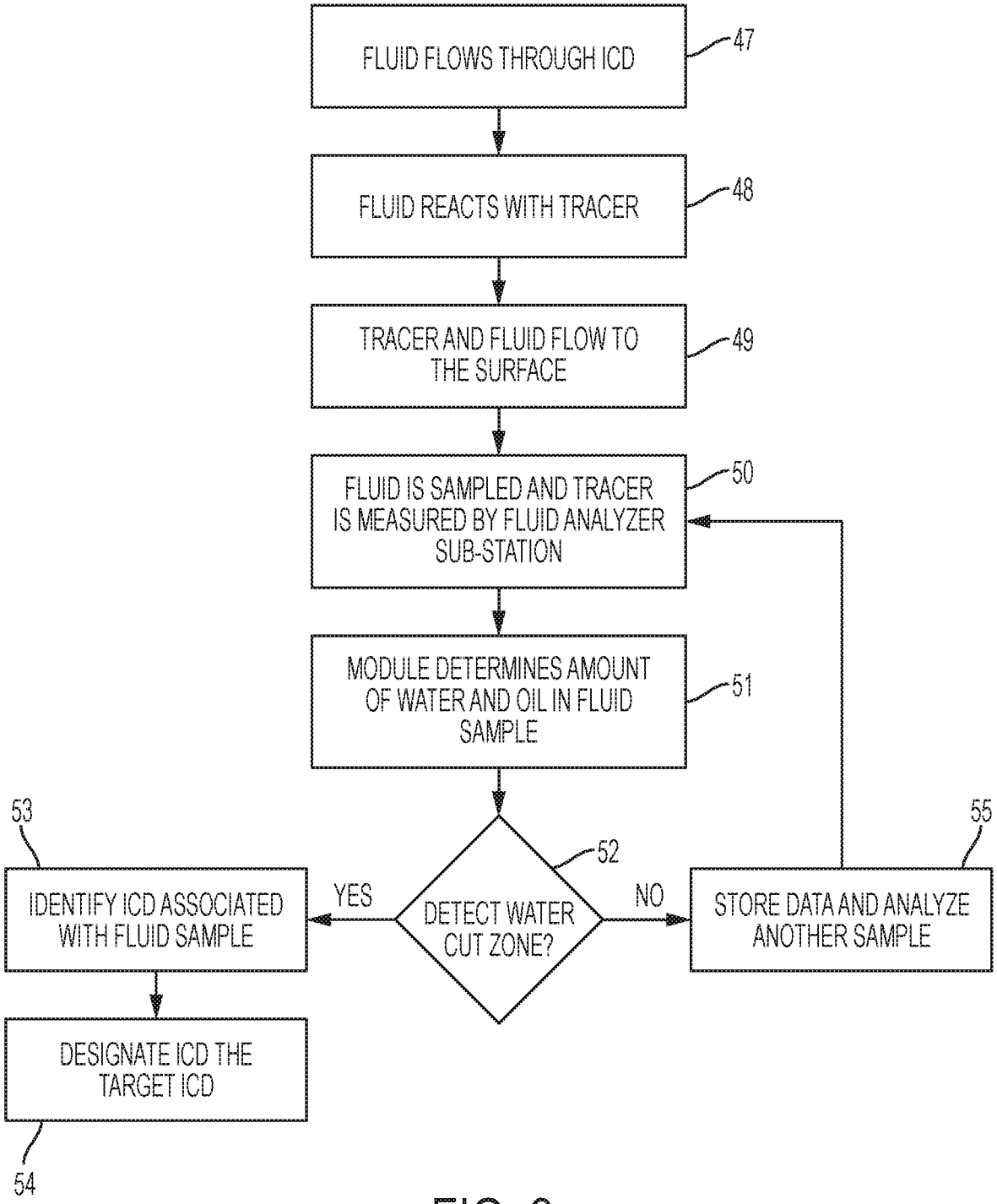
FIG. 9 is a flowchart that shows an example process for identifying water cut zones in a well.

FIG. 9 shows an example process for using a chemical tracer to identify a water cut zone. According to the example process of FIG. 9, production fluid flows (47) through an ICD. The production fluid reacts (48) with chemical tracer at the ICD. Chemical tracer and production fluid flow (49) through the well to the surface. The production fluid is sampled and the chemical tracer constituent of the production fluid is measured (50) by fluid analyzer sub-station 2. Chemical tracer analyzer module 29 may determine (51) the amount of water in a fluid sample by analyzing data representing the amount of chemical tracer in a fluid.

Chemical tracer analyzer module 29 may determine the amount of water in a fluid sample by identifying the types of chemical tracer present in a production fluid sample. Chemical tracer analyzer module 29 may retrieve stored data 27 from memory 26, which may include information indicating whether the chemical tracer reacts with water or oil. Measurements of chemical tracer that reacts with water may be compared with measurements of chemical tracer that reacts with oil. The comparison may be reflected as a percentage of water in a fluid sample or the ratio of water to oil in the fluid sample. In this example, the output of chemical tracer analyzer module 29 includes data that represents the amount of water in a fluid sample. Chemical tracer analyzer module 29 may instruct computing system 3 to store the output in memory 26 as part of data 27. Data 27 may be continually stored and updated as new data is acquired.

A water cut zone may be detected (52) by water cut zone identification module 31 based on the output of chemical tracer analyzer module 29. In an example, water cut zone identification module 31 may identify a water cut zone if the percentage of water or the ratio of water to oil in a sample exceeds a predetermined threshold. The predetermined threshold may be included stored data 27 in memory 26. For example, the predetermined threshold may be the threshold that indicates an intervention is necessary. An intervention may include communicating with controllers in the ICDs to close an ICD. The predetermined threshold may be when a fluid sample is greater than or equal to 50% water. The water cut zone identification module 31 compares the percentage of water calculated by the chemical tracer analyzer module 29 to the predetermined threshold and determines if the percentage of water has exceeded the threshold. In another example, a water cut zone may be determined if the percentage of water in a production fluid sample or if the ratio of water to oil in the production fluid sample is increasing from previous measurements at a rate above a threshold.

If a water cut zone is detected (52), water cut zone identification module 31 identifies (53) the ICD associated with the fluid sample, thereby identifying the ICD associated with the water cut zone. Water cut zone identification module 31 may identify the signature or unique mix of the chemical tracer identified in fluid sample and compare it to stored data 27 relating to the chemical tracer signature of each ICD. The ICD associated with the fluid sample is identified and designated (54) the target ICD. If a water cut zone is not detected (52)—for example, if the percentage of water or ratio of water to oil in a sample does not exceed a threshold—water cut zone identification module 31 may store data and analyze (55) another fluid sample.

The operations shown in FIG. 9 for identifying water cut zones using chemical tracer analyzer module 29 and water cut zone identification module 31 may be performed simultaneously for multiple chemical tracers. In some implementations, multiple target ICDs may be identified within a single wellbore.

Chemical tracer analyzer module 29 or water cut zone identification module 31 may generate the display comprising a graphical output or an alert on a display screen of display device 24. For example, display device 24 may display the amount of water or oil, or both water and oil, in one or more production fluid samples. The amount of water or oil in one or more production fluid samples may be numerically represented. The amount of water and oil in one or more production fluid samples may be graphically represented. For example, colors may be assigned to represent oil or water present in a production fluid sample. The ratio of water to oil in a production fluid sample may be displayed. Display device 24 may be configured to display data analyzed over time. Display device 24 may display multiple windows. A window may show data analyzed from a specific ICD. An alert may be displayed on a smart phone of a worker on site or at a remote location. The alert may indicate that a water cut zone has been identified. An alert may be in the form of an audible or a visual alert and may be an alert that is sent wirelessly to an off-site location. Examples of alerts include electronic mail (e-mail) messages and simple message service (SMS or text) messages.

As described, after a water cut zone is identified in a well, an intervention may occur to isolate the water cut zone by closing one or more ICDs in the water cut zone. An ICD in the water cut zone may be designated as a target ICD. A communication and control system may be incorporated into the wellbore and at the surface in order to communicate instructions downhole to initiate closure of the target ICD.

In some implementations, fluid analyzer devices located downhole may be used to measure fluid properties of production fluid to identify water cut zones. A fluid analyzer device may include one or more on-board processing devices, solid state circuitry, or both one or more on-board processing devices and solid state circuitry configured to identify the content of production fluid entering the wellbore. In some examples, a fluid analyzer device may be incorporated into each ICD. A fluid analyzer device may be configured to sample fluid flowing through the ICD into the wellbore and to analyze the content of the fluid. The fluid analyzer device may be configured to output information to the computing system relating to properties of the production fluid. The properties may include, for example, the density of the fluid, a salinity of the fluid, or both a density of the fluid and a salinity of the fluid.

Figure 3:
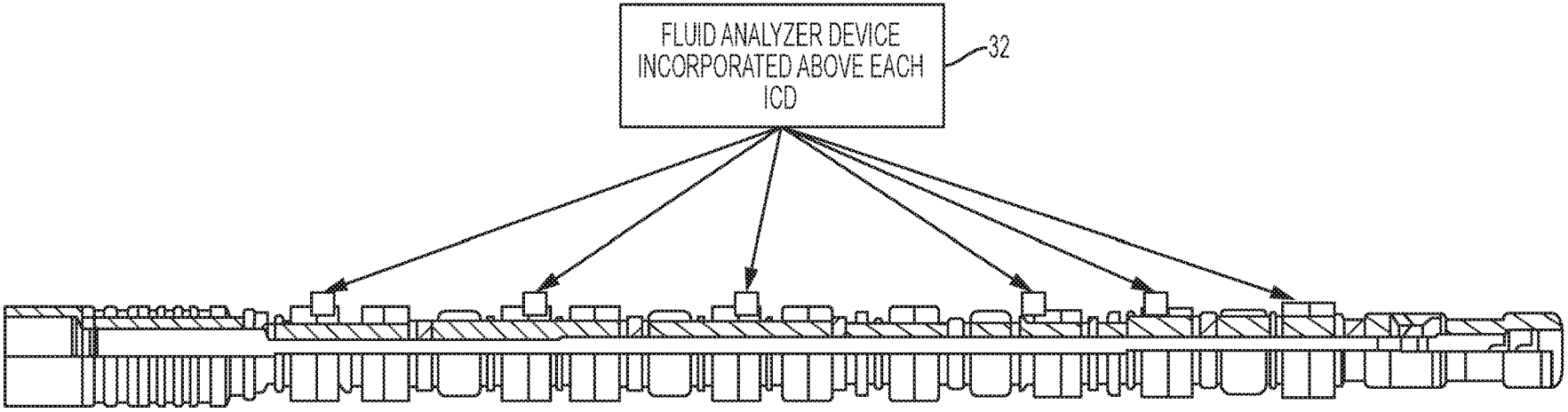
FIG. 3 is a cut-away, side view of an example completion string having ICDs, each containing a fluid analyzer device to analyze fluid entering the ICD.
Figure 5:
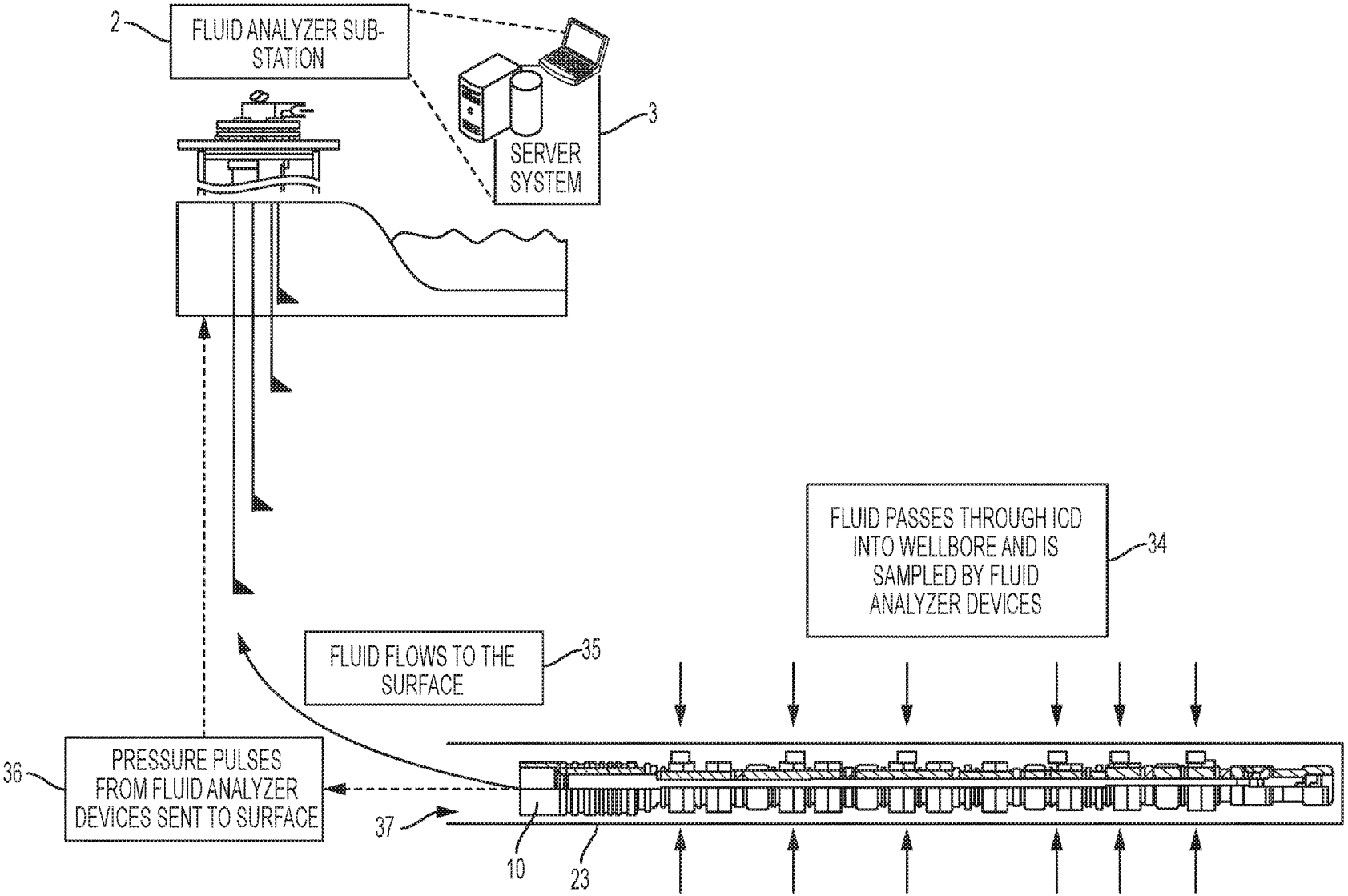
FIG. 5 is a cut-away, side view of an example system for identifying water cut zones that includes fluid analyzer devices incorporated into ICDs.

In some implementations, individual fluid analyzer devices may be installed at the site of, or slightly above, corresponding ICDs along the completion string. An example installation is shown in the configuration of FIG. 3. In this example, fluid analyzer devices 32 may be or include microprocessors embedded in the completion string. As shown in the example of FIG. 5, production fluid may enter from formation 23 into wellbore 37 by passing through the ICDs. As the production fluid flows into the wellbore, the production fluid is sampled (34) by the fluid analyzer devices. The fluid analyzer devices measure properties of the production fluid. The properties may include the density of the production fluid, a salinity of the production fluid, or both a density of the production fluid and a salinity of the production fluid. The fluid analyzer device may identify, based on the fluid properties of the sampled production fluid, the types of fluid that comprise the production fluid, such as water and oil or other hydrocarbon.

A fluid analyzer device may distinguish water from oil by measuring fluid properties that differ between oil and water, such as density or salinity. A fluid analyzer device may also be configured to measure other properties of the fluid that may distinguish water from oil, such as radio frequency (RF) admittance. A fluid analyzer device may determine the amount of water or oil in a fluid by measuring such properties and by comparing measured values to thresholds. A fluid analyzer device may generate an output based on the fluid properties. The output may be digital data representing the fluid property measurements. The output may be sent to the fluid analyzer substation. In some implementations, a fluid analyzer device may generate an output in the form of a pressure pulse. The pressure pulse may be received by pressure sensors of fluid analyzer sub-station 2. A pressure pulse sent from a fluid analyzer device may be a pulse waveform that is unique to that fluid analyzer device. A pressure pulse may propagate using the production fluid flowing to the surface.

FIG. 5 shows an example system that employs fluid analyzer devices downhole. In FIG. 5, production fluid flows (35) to the surface. Pressure pulses are generated by the fluid analyzer devices and are sent (36) to the surface. The pressure pulses may include a pulse waveform unique to a specific fluid analyzer device.

As described, fluid analyzer sub-station 2 may include one or more pressure sensors configured to receive and to decode pressure pulses from fluid analyzer devices 32. For example, computing system 3 may include a pulse analyzer module 30. Pulse analyzer module 30 may be configured to determine the amount of water in a production fluid sample by analyzing data representing fluid property measurements received from fluid analyzer devices downhole. Pressure pulses received from multiple fluid analyzer devices may be analyzed simultaneously by pulse analyzer module 30. In some implementations, each pressure pulse may also encode a pulse waveform unique to a specific fluid analyzer device. Thus, the computing system may identify the fluid analyzer device from which a pressure pulse originated based on its pulse waveform.

Pulse analyzer module 30 may generate digital data based on information encoded in received pressure pulses. The digital data may represent fluid properties, as described above, such as the density or salinity of the fluid sample. Based on the digital data, pulse analyzer module 30 may determine the amount of water in a fluid sample. This amount may be reflected as a percentage of water in a fluid sample or the ratio of water to oil in a sample.

In some implementations, pulse analyzer module 30 may be incorporated into the on-board processing device of a fluid analyzer device downhole. In such implementations, the fluid analyzer device may determine the amount of water in a fluid sample and transmit a pressure pulse to the surface. As noted, the pressure pulse may encode digital data representing properties a production fluid sample, such as the amount of water in the fluid sample. Pulse analyzer module 30 may generate an output, based on the amount of water in the fluid sample. Pulse analyzer module 30 may initiate display of the analyzed data as a graphical output or alert on a display screen of display device 24. Examples of the types of display may be one of the examples previously described.

In an example, water cut zone identification module 31 may identify a water cut zone if the percentage of water or the ratio of water to oil in a production fluid sample exceeds a threshold. That threshold may be stored in memory 26. For example, the threshold may be indicative of whether an intervention is necessary. An intervention may include communicating with controllers at the ICDs to close an ICD. The threshold may indicate that a fluid sample is greater than or equal to 50% water. The water cut zone identification module 31 is configured to compare the percentage of water determined by pulse analyzer module 30 to the threshold and to determine if the percentage of water has exceeded the threshold. In another example, a water cut zone may be identified if the percentage of water in a sample or if the ratio of water to oil is increasing at a rate that exceeds a predetermined threshold.

If a water cut zone is detected, water cut zone identification module 31 identifies the location of the water cut zone. Water cut zone identification module 31 may use the unique pulse waveform encoded by the pressure pulse sent from the fluid analyzer device to identify the ICD producing the water cut zone. In this regard, data 27 may include data representing the unique pulse waveform of each fluid analyzer device and the particular fluid analyzer device associated with each ICD. Using data 27, a unique pressure waveform may be matched to a particular ICD. The ICD associated with the unique pressure waveform is designated the target ICD. Multiple target ICDs may be identified simultaneously. Water cut zone identification module 31 may initiate display of the analyzed data as a graphical output or alert on a display screen of display device 24. Examples of the types of display may be one of the examples previously described.

If a water cut zone is not detected—for example, if the percentage of water or ratio of water to oil in a sample does not exceed a threshold—water cut zone identification module 31 may store the data.

When an ICD is designated as the target ICD, an intervention may occur to isolate the water cut zone and to close the target ICD without interrupting well production. This intervention may include one or more controllers. As described, a controller may be incorporated into each ICD. The controllers may be configured to receive and to transmit RFID signals. The controllers may also be configured to store and to process information encoded in the RFID signals. The controllers may be configured to control the opening and closing of the ICDs. Examples of controllers include the computing or processing devices described in this specification.

In this regard, in some implementations, each controller may be configured to send RFIDs to, and to receive RFIDs from, computing system 3 or other controllers. Each controller may be configured to receive an RFID and determine, based on the RFID, whether an ICD is a target for the RFID. A controller at an ICD may be designated as a target for the RFID. For example a controller may store in its memory or elsewhere a unique RFID signature. A receiver, which may be part of the controller, receives a transmitted RFID and compares the transmitted RFID to the stored RFID signature. If the two match, or are within an appropriate tolerance of each other, then the ICD is determined to be the target for, or designated for, the transmitted RFID.

A controller may be configured to operate an ICD to control the inflow of water by opening or closing the ICD in a case that the ICD is the target for the RFID. For example, the controller may be configured to receive a transmitted RFID and, if the controller is the target for the transmitted RFID, the controller operates to close the ICD. In some cases, the controller may be configured to open the ICD in a case that the controller is the target of the transmitted RFID. In this regard, an RFID signal may include instructions defining a control sequence. The control sequence may cause various ICDs to open or close at times specified in the control sequence.

If the controller is not the target for the RFID in the transmitted RFID signal, the controller may be configured to repeat—that is, to retransmit—the RFID signal. For example, the controller may transmit the RFID signal to one or more other controllers. In some examples, the one or more other controllers may be located further downhole of the controller. In some examples, the one or more other controllers may be located uphole of the controller. In some examples, the one or more other controllers may be located both uphole and downhole of the controller.

Figure 7:
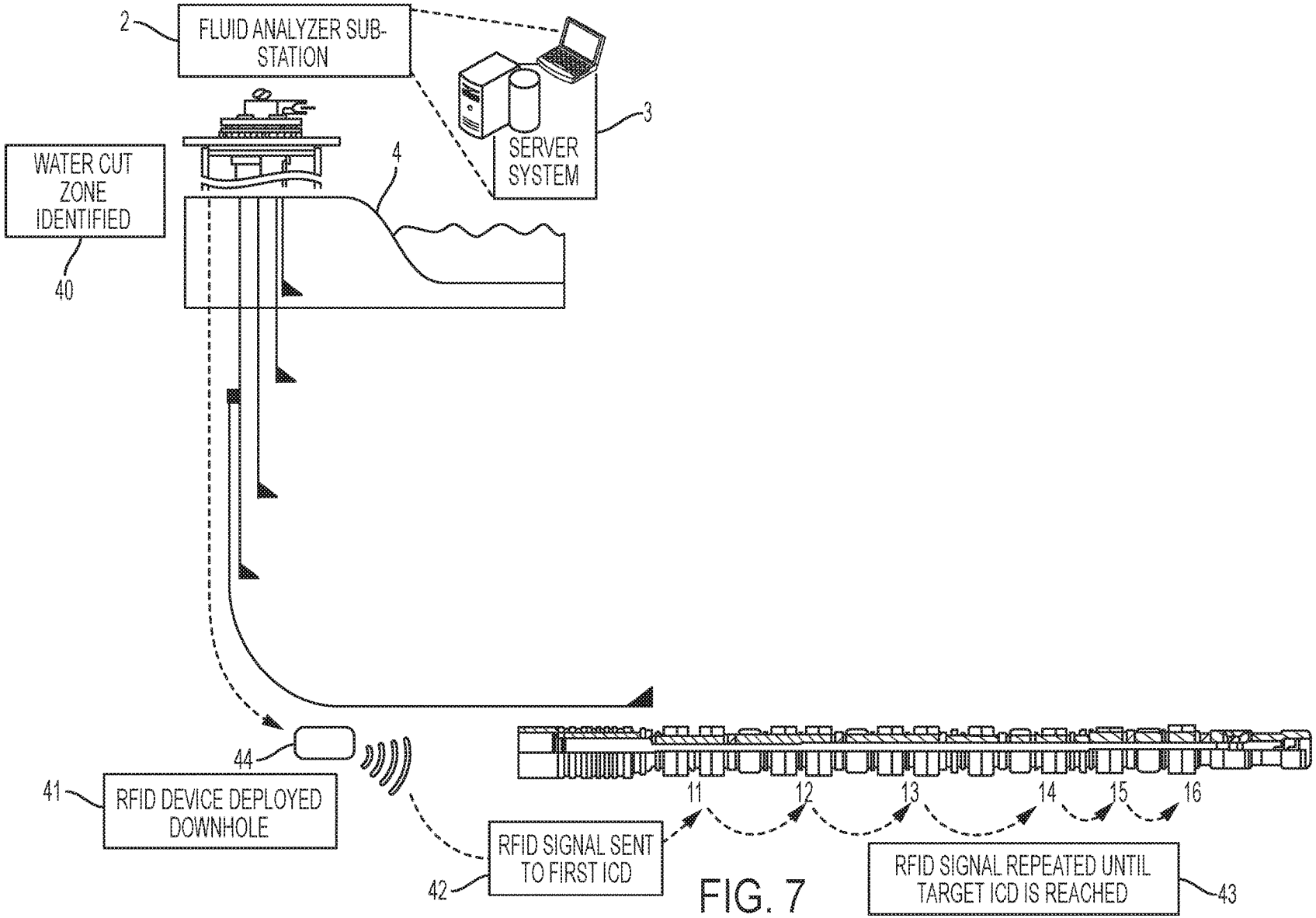
FIG. 7 is a cut-away, side view of an example system for isolating water cut zones that includes a radio frequency identification (RFID) communication system having controllers incorporated into the ICDs and a downhole RFID device.

FIG. 7 shows an example system for isolating water cut zone in a wellbore. The example system of FIG. 7 includes an RFID communication system. The RFID system includes controllers 11, 12, 13, 14, 15, and 16 incorporated into ICDs and downhole RFID device 44. As described, when a water cut zone is identified (40) a target ICD is designated. Instructions, which may include a control sequence encoded in an RFID signal, may be sent from the surface computing system 3 to the controllers.

To send the RFID signal to the controllers, an RFID device 44 is deployed (41) downhole. The RFID device may be a transmitter having a range that is limited to several meters, in an example. The RFID device may be lowered downhole by a surface actuated mechanism. RFID device 44 generates an RFID signal that identifies a target ICD. RFID device 44 sends (42) the RFID signal to the first ICD that it encounters. A controller incorporated into that ICD proximate to the RFID device receives the RFID signal. The controller decodes data contained in the RFID signal. The data may include instructions for the controller to execute a control sequence. The control sequence may cause the ICD to close. If the first ICD is not the target ICD, the controller corresponding to that ICD will not be able to decode the RFID signal and will instead repeat the RFID signal. For example, the RFID signal may be repeated downhole or to another controller uphole. The instructions may be received by the controller at the next ICD downhole. The RFID signal encoding the control sequence is repeated (43) until the target ICD is reached. In this context, repeating includes controllers that are not the target controller re-sending the RFID signal.

Figure 10:
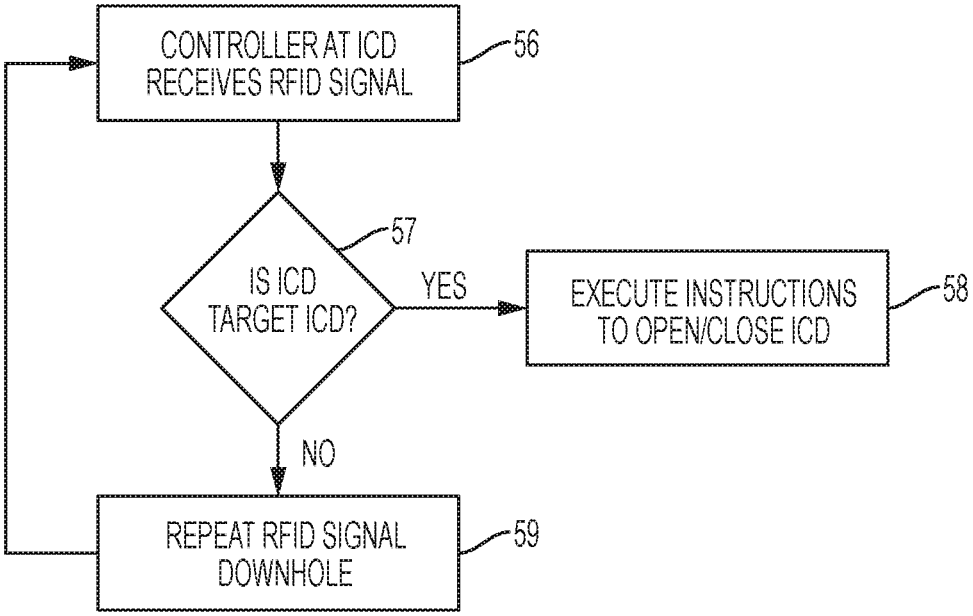
FIG. 10 is a flowchart that shows an example process for isolating water cut zones in a well.

According to the process of FIG. 10, an RFID device outputs an RFID signal downhole. A controller proximate to the RFID device receives (56) the RFID signal. For example, the controller may be within a transmission range of the RFID device. Other controllers may not receive the RFID signal because they may be out of transmission range. The controller determines (57), based on the RFID, whether an ICD associated with the controller is a target for the RFID device based on the RFID. If the ICD is the target, then the controller decodes the RFID signal. In this regard, the RFID signal includes instructions for controlling operation of the target ICD. The controller executes (58) those instructions to control the ICD. For example, the instructions may cause the ICD to open, to close, or to open and close in a sequence specified by the instructions. If the ICD is not the target for the RFID, then the controller does not decode the RFID signal. Instead, the controller repeats (59) the RFID signal. For example, the controller may transmit the RFID signal uphole, downhole, or both. Another controller receives the RFID signal and repeats this process. This process continues until the target ICD is reached or until all ICDs in the wellbore are considered.

Figure 8:
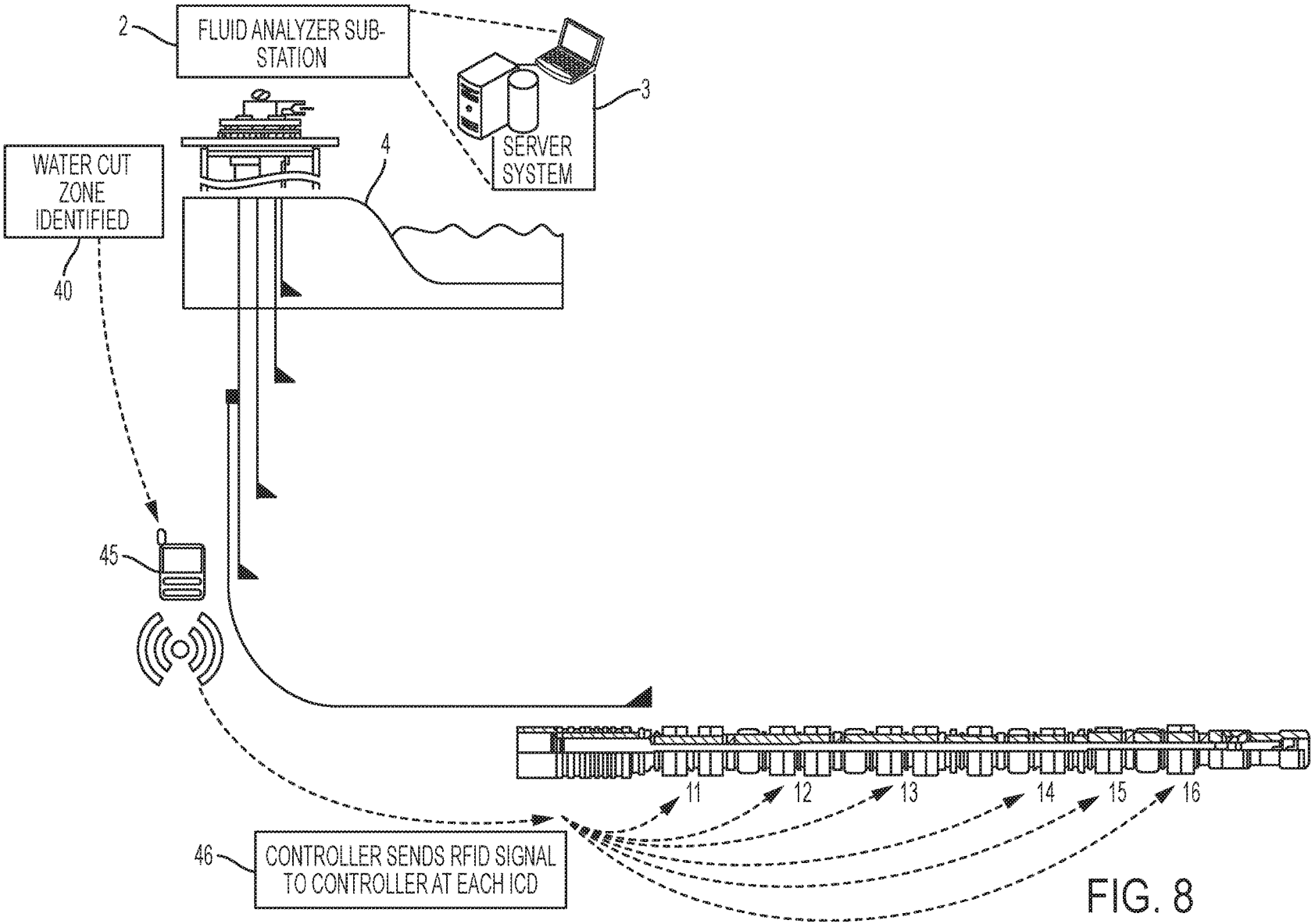
FIG. 8 is a cut-away, side view of an example system for isolating water cut zones that includes a radio frequency identification (RFID) communication system having controllers incorporated into ICDs and a controller installed on a liner hanger in a well.

FIG. 8 is an example system for isolating water cut zones that includes a radio frequency identification (RFID) communication system. Controllers are incorporated into the ICDs of the completion string. Another controller 45 is incorporated into a liner hanger installed in the wellbore. In some implementations, instances of controller 45 may be incorporated into various locations along the wellbore or at the surface. The location of controller 45 may depend on the conditions of the well or the type of well. Controller 45 may have a transmission range sufficient to reach all ICDs in the wellbore and their corresponding controllers.

As shown in the example of FIG. 8, a water cut zone is identified (40) and a target ICD is designated. Instructions, including a control sequence encoded in an RFID signal are sent downhole from computing system 3 to controller 45. Instructions may be sent downhole to controller 45 using an RFID device, as described with respect to FIG. 7. Controller 45 sends (46) the RFID signal to the controller at each ICD. The controllers at each ICD may be configured to receive the RFID signal. The controller at the target ICD decodes the instructions and executes the control sequence to close the ICD. Controller 45 may be configured to decode the instructions received from computing system 3 and identify the ICD that is the target for the RFID. Controller 45 may then send the instructions to the controller that is the target for the RFID.

All or part of the system and processes described in this specification and their various modifications (subsequently referred to as "the systems") may be controlled at least in part, by one or more computers using one or more computer programs tangibly embodied in one or more information carriers, such as in one or more non-transitory machine-readable storage media. A computer program can be written in any form of programming language, including compiled or interpreted languages, and it can be deployed in any form, including as a stand-alone program or as A module, part, subroutine, or other unit suitable for use in a computing environment. A computer program can be deployed to be executed on one computer or on multiple computers at one site or distributed across multiple sites and interconnected by a network.

Actions associated with controlling the systems can be performed by one or more programmable processors executing one or more computer programs to control all or some of the operations described previously. All or part of the processes can be controlled by special purpose logic circuitry, such as, an FPGA (field programmable gate array), an ASIC (application-specific integrated circuit), or both an FPGA and an ASIC.

Processors suitable for the execution of a computer program include, by way of example, both general and special purpose microprocessors, and any one or more processors of any kind of digital computer. Generally, a processor will receive instructions and data from a read-only storage area or a random access storage area or both. Elements of a computer include one or more processors for executing instructions and one or more storage area devices for storing instructions and data. Generally, a computer will also include, or be operatively coupled to receive data from, or transfer data to, or both, one or more machine-readable storage media, such as mass storage devices for storing data, such as magnetic, magneto-optical disks, or optical disks. Non-transitory machine-readable storage media suitable for embodying computer program instructions and data include all forms of non-volatile storage area, including by way of example, semiconductor storage area devices, such as EPROM (erasable programmable read-only memory), EEPROM (electrically erasable programmable read-only memory), and flash storage area devices; magnetic disks, such as internal hard disks or removable disks; magneto-optical disks; and CD-ROM (compact disc read-only memory) and DVD-ROM (digital versatile disc read-only memory).

Elements of different implementations described may be combined to form other implementations not specifically set forth previously. Elements may be left out of the processes described without adversely affecting their operation or the operation of the system in general. Furthermore, various separate elements may be combined into one or more individual elements to perform the functions described in this specification.

Other implementations not specifically described in this specification are also within the scope of the following claims.

What is claimed is:

1. A system comprising:

a casing string for insertion into a wellbore;

one or more inflow control devices (ICDs) disposed along the casing string, the one or more ICDs for controlling inflow of water into the wellbore; and one or more controllers, a controller being associated with an ICD, the controller being configured to receive a radio frequency identification (RFID) and to determine whether the ICD is a target for the RFID;

where the controller is configured to control the ICD to control the inflow of water by opening or closing the ICD in a case that the ICD is the target for the RFID, and where the controller is configured to repeat the RFID in a case that the ICD is not the target for the RFID.

2. The system of claim 1, further comprising:

a device configured to identify a water cut zone associated with the ICD, where the water cut zone is identified based on one or more properties of fluid entering the ICD, the fluid comprising water and oil, the device being configured to transmit information based on the one or more properties.

3. The system of claim 2, where the information comprises a density of the fluid, a salinity of the fluid, or both a density of the fluid and a salinity of the fluid.

4. The system of claim 2, where transmitting the information comprises emitting a pressure pulse from the device, the pressure pulse being unique to the device, and where the one or more properties of the fluid comprises a percentage of water in the fluid exceeding a predetermined threshold.

5. The system of claim 4, further comprising:

a computing system configured to identify the pressure pulse and to correlate the pressure pulse to a location of the device downhole thereby identifying a location of the water cut zone, and where the predetermined threshold comprises 50% or more water in the fluid.

6. The system of claim 1, further comprising:

one or more chemical tracers associated with the ICD to identify a water cut zone, where the water cut zone is identified based on one or more properties of fluid entering the ICD from the water cut zone, the fluid comprising water and oil, the one or more chemical tracers being configured to react with at least one of the water or the oil to identify the water cut zone, and where the one or more chemical tracers comprises at least one of a soluble ion and an oil-based chemical tracer.

7. The system of claim 6, where the one or more chemical tracers comprises two chemical tracers, one of the chemical tracers for reacting with the water and one of the chemical tracers for reacting with the oil, and where the one or more chemical tracers comprises at least one of mono-fluorinated benzoic, di-fluorinated benzoic, tri-fluorinated benzoic acid, 2-fluorobenzoic acid, 4-fluorobenzoic acid, 6-fluorobenzoic acid, and trifluoromethylbenzoic acid.

8. The system of claim 6, further comprising:

a computing system configured to identify the one or more chemical tracers and to determine, based on reactions with the one or more chemical tracers, an amount of the water, an amount of the oil, or the amount of the water and the amount of the oil, the water cut zone being identified based on at least one of: the amount of the water, the amount of the oil, or the amount of the water and the amount of the oil.

9. The system of claim 8, where the computing system is located at a surface of the wellbore, the wellbore being configured to enable the one or more chemical tracers to pass to the surface for analysis, and where the one or more chemical tracers comprises at least one of nitrate (NO—), hydrogen borate (HOB—), deuterium, and tritium.

10. The system of claim 8, where the computing system is configured to identify the one or more chemical tracers and to correlate the one or more chemical tracers to a location of an ICD downhole in order to identify a location of the water cut zone, and where the one or more chemical tracers comprises at least one of iododecane, hexadecane, and thiocyanate anion.

11. The system of claim 1, further comprising:

a computing system communicatively coupled to the one or more controllers, the computing system comprising a pulse analyzer module; and multiple fluid analyzers fluidly coupled to the casing string, where the controller is configured to control the inflow of water by closing the ICD in a case that the ICD is the target for the RFID, and where pressure pulses from the multiple fluid analyzers are analyzed simultaneously by the pulse analyzer module.

12. The system of claim 11, where the one or more controllers comprise multiple controllers, at least one of the multiple controllers being configured to receive an RFID from another, different controller located uphole in the wellbore, and where each pressure pulse encodes a pulse waveform unique to a specific fluid analyzer of the multiple fluid analyzers.

13. The system of claim 1, where the one or more controllers comprise multiple controllers, at least one of the multiple controllers being configured to receive an RFID from a device located downhole in the wellbore.

14. A method comprising:

analyzing fluid from one or more inflow control devices (ICDs) disposed along a casing string in a wellbore in order to determine a property of the fluid;

identifying a water cut zone in the wellbore based on the property;

identifying a target ICD associated with the water cut zone;

transmitting a radio frequency identifier (RFID) downhole in to the wellbore, the RFID comprising an instruction that is addressed to a target controller among multiple controllers associated with respective ICDs, at least some of the controllers being configured to repeat the RFID within the wellbore so that RFID reaches the target controller; and the target controller controlling an associated ICD based on the instruction.

15. The method of claim 14, where analyzing the fluid comprises:

identifying one or more chemical tracers in the fluid, the one or more chemical tracers being configured to react with water or oil; and measuring amounts of the one or more chemical tracers in the fluid, the amounts corresponding to amounts of at least one of water and oil in the fluid.

16. The method of claim 15, further comprising directing the fluid to a location containing a fluid analyzer, the fluid analyzer providing information to a computing system, the computing system identifying amounts of oil and water in the fluid based on the information, and where the one or more chemical tracers comprises at least one magnetic nanoparticle fragment.

17. The method of claim 15, where identifying one or more chemical tracers comprises identifying, at a computing system, one or more chemical tracers, where the computing system is configured to identify a chemical tracer and to correlate the chemical tracer to a location of an ICD at a location of the water cut zone, and where the one or more chemical tracers comprises short stranded deoxyribonucleic acid.

18. The method of claim 14, where the target controller receives an RFID from a different controller uphole of the target controller.

19. The method of claim 14, where the target controller receives an RFID from a device downhole of the target controller.

20. A system comprising:

a casing string for insertion into a wellbore;

at least two inflow control devices (ICDs) disposed along the casing string, the at least two ICDs for controlling inflow of water into the wellbore;

at least two controllers, each controller being associated with an ICD, each controller being configured to receive a radio frequency identification (RFID) and to determine whether the ICD is a target for the RFID; and at least two fluid analyzers disposed downhole along the casing string, where the at least two controllers are configured to control the at least two ICDs to control the inflow of water by opening or closing each ICD in a case that the ICD is the target for the RFID, and where the at least two controllers are configured to repeat the RFID in a case that the ICD is not the target for the RFID.

21. The system of claim 20, where each fluid analyzer is disposed above an ICD.

22. The system of claim 21, where each of the at least two ICDs and each of the at least two fluid analyzers are disposed along a horizontal portion of the casing string.

23. The system of claim 22, further comprising one or more chemical tracers associated with the ICD to identify a water cut zone;

where each of the at least two fluid analyzers comprises a sub-system for measuring the one or more chemical tracers, and where the sub-system comprises mass spectrometry equipment.

24. The system of claim 22, further comprising one or more chemical tracers associated with the ICD to identify a water cut zone;

where each of the at least two fluid analyzers comprises a sub-system for measuring the one or more chemical tracers, and where the sub-system comprises at least one scintillation detector.

* * * * *